US009970200B1

(12) United States Patent
Malfatti et al.

(10) Patent No.: US 9,970,200 B1
(45) Date of Patent: May 15, 2018

(54) RAISED ADJUSTABLE INSULATED FLOORING SYSTEM

(71) Applicants: Steven Malfatti, Scarborough (CA); Gregory Holowaty, Toronto (CA)

(72) Inventors: Steven Malfatti, Scarborough (CA); Gregory Holowaty, Toronto (CA)

( * ) Notice: Subject to any disclaimer, the term of this patent is extended or adjusted under 35 U.S.C. 154(b) by 0 days. days.

(21) Appl. No.: 15/429,749

(22) Filed: Feb. 10, 2017

(51) Int. Cl.

| | |
|---|---|
| ***E04G 1/22*** | (2006.01) |
| ***E04F 15/024*** | (2006.01) |
| ***E04B 1/76*** | (2006.01) |
| ***E04B 1/28*** | (2006.01) |
| ***E04B 5/48*** | (2006.01) |
| ***E04F 15/02*** | (2006.01) |
| ***E04F 15/18*** | (2006.01) |

(52) U.S. Cl.
CPC ..... *E04F 15/02464* (2013.01); *E04B 1/28* (2013.01); *E04B 1/76* (2013.01); *E04B 5/48* (2013.01); *E04F 15/0215* (2013.01); *E04F 15/02044* (2013.01); *E04F 15/02194* (2013.01); *E04F 15/02452* (2013.01); *E04F 15/02458* (2013.01); *E04F 15/181* (2013.01)

(58) Field of Classification Search
CPC ..... E04B 1/28; E04B 1/76; E04B 5/48; E04F 15/02044; E04F 15/0215; E04F 15/02194; E04F 15/02452; E04F 15/02458; E04F 15/181; E04F 15/02464; E04F 2015/02061
See application file for complete search history.

(56) References Cited

U.S. PATENT DOCUMENTS

| | | | | |
|---|---|---|---|---|
| 2002/0152712 | A1* | 10/2002 | Smith | E04L 35/12 52/650.3 |
| 2003/0196402 | A1* | 10/2003 | Roen | E04L 35/10 52/507 |
| 2009/0029086 | A1* | 1/2009 | Wallin | E04B 5/48 428/44 |
| 2010/0162645 | A1* | 7/2010 | Cox | B61B 1/02 52/220.1 |
| 2012/0131862 | A1* | 5/2012 | Hashimoto | E04F 15/02452 52/126.6 |
| 2012/0240484 | A1* | 9/2012 | Blom | E04F 15/02044 52/126.7 |
| 2014/0237912 | A1* | 8/2014 | Kugler | E04F 15/02464 52/126.6 |
| 2017/0037631 | A1* | 2/2017 | McManus | E04F 15/02005 |

FOREIGN PATENT DOCUMENTS

| | | | | |
|---|---|---|---|---|
| JP | 09032246 A | * | 2/1997 | E04F 15/02044 |
| JP | 2006291705 A | * | 10/2006 | E04F 15/02044 |

* cited by examiner

*Primary Examiner* — Brian D Mattei
(74) *Attorney, Agent, or Firm* — Nasser Ashgriz; UIPatent Inc.

(57) ABSTRACT

The present invention is a raised flooring system adapted for use in commercial and residential flooring construction. The flooring system comprises of inverted-T-shaped tracks with a plurality of adjustable supporting legs mounted thereon to adjust the height of the inverted-T-shaped track. The inverted-T-shaped tracks create a void space for air circulation, installation of insulation panels, noise reduction, in-floor heating and water drainage. The void space also allows for cables and services to run below the floor. The inverted-T-shaped track is made of rigid insulation which is durable and mold resistant.

6 Claims, 7 Drawing Sheets

RAISED ADJUSTABLE INSULATED FLOORING SYSTEM

FIELD OF THE INVENTION

The present invention relates, in general, to construction products and, in particular, to flooring products used in construction.

BACKGROUND OF THE INVENTION

Assembly of a raised floor in construction is one of the routine activities for builders. Raised flooring systems are used in a wide range of situations. Raised flooring provides an extra space to run wiring, pipes, air ducts, and other mechanical and electrical systems. These systems run in the cavity beneath the raised flooring, where they are hidden from view and do not cause obstructions atop the flooring. One common use of raised floorings is in the computer/telecom industry, to provide a space for computer/telecom equipment.

Another application of raised flooring is in residential housing—in particular, in basements. The basement foundation in residential housing is usually concrete. Direct installation of hardwood and/or fiberboard on the basement floor is not recommended, since these may absorb moisture, expand, warp and rot. They are a common source of mold and mildew, creating a hazardous living environment and contaminated air quality. Therefore, raised flooring systems may also be suitable for basements in residential housing.

Raised flooring systems prevent moisture from becoming trapped, by creating a gap between the flooring and the concrete base. Air flow underneath the floor allows moisture to evenly dissipate without having to remove the flooring in the event of moisture buildup. Raised flooring systems are also good thermal insulators, reducing energy loss.

There are several issues that regularly arise during the installation of traditional raised flooring systems. One important issue is the leveling of a raised floor. Another issue relates to the installation of a heating source underneath the floor to provide heat and also to facilitate air passage underneath the whole flooring system to prevent water condensation.

Traditional raised flooring systems are usually made of square steel panels that are interconnected. These systems are expensive and difficult to assemble and because of the height of the product, a greater ceiling height is usually required. Therefore, they are mainly used in commercial buildings and are usually not suitable for residential housing.

Another method of installing raised flooring systems is by first constructing a set of raised rectangular frames and then setting steel panels in the frames. The frame may include a set of pedestals resting on concrete or other base flooring. These older raised flooring systems are cumbersome to build and the marginal cost is high, particularly for residential housing.

Therefore, there is a need for a new approach to raised flooring, which is appropriate for both commercial and residential construction—an approach that is more functional, lightweight, inexpensive, with excellent thermal and acoustic properties and moisture control.

SUMMARY OF THE INVENTION

The present invention is a raised adjustable insulated flooring system that can be used on a new or an existing flooring structure. The void space created by the flooring system allows for air circulation below the floor to facilitate drainage and prevent moisture condensation. The present invention increases thermal resistance through the installation of rigid insulation panels. Additionally, an in-floor heating system helps to regulate the temperature of the floor, thereby increasing comfort. The void space also allows for mechanical and electrical equipment, such as cables and pipes, to run below the floor. The present invention also reduces sound transmission (i.e., increase the sound transmission class (STC) rating). This would be useful in multistory buildings, where additional sound and thermal insulation is desirable between floors.

The present invention comprises of a set of inverted-T-shaped tracks made of insulation material with a plurality of adjustable supporting legs mounted thereon. The inverted-T-shaped tracks (insulation) are longitudinally cut out of rigid insulation and have a predefined length, width and depth according to the flooring area. The lower end of the Inverted-T-shaped track (insulation) is mounted on an existing or a new concrete slab. Conventional flooring, such as hardwood, laminate or tiles, are usually installed atop the upper end of the inverted-T-shaped track (insulation).

The adjustable support legs are mounted at a predefined distance from one another. The height of the legs is adjusted to provide a predefined slope for the raised floor, to facilitate drainage of water to a floor drain.

Once the inverted-T-shaped track is installed, a void area is created which can be used to insert insulation panels and other components. The notched rigid insulation panels will be glued into place with an adhesive. This minimizes the areas where air and water can penetrate. Because most of the flooring system is composed of one material, this allows for maintenance of a uniform temperature, reducing condensation and subsequent mold formation. Because the inverted-T-shaped tracks are adjustable from above, they can be easily and quickly installed by a contractor or even a home owner, with minimal training.

The present invention consists primarily of rigid insulation. This material is durable and mold resistant, ensuring longevity of the flooring system. All metallic components are galvanized or stainless steel to minimize rusting. The present invention is versatile enough to work with any type of pre-existing, including those with pre-existing in-floor heating and noise reduction systems.

It is an object of the present invention to provide a raised flooring system with excellent thermal and sound resistance.

It is another object of the present invention to provide a raised flooring system which is easy to install by both contractors and home owners alike.

It is another object of the present invention to provide a raised flooring system with sufficient airflow underneath to prevent subsequent mold and mildew.

It is another object of the present invention to provide a raised flooring system that is inexpensive, both for commercial and domestic applications.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

The figures are not intended to be exhaustive or to limit the present invention to the precise form disclosed. It should be understood that the invention can be practiced with modification and alteration, and that the disclosed technology be limited only by the claims and equivalents thereof.

DETAILED DESCRIPTION OF PREFERRED EMBODIMENTS

The flooring system disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

Figures 1A, 1B, 1C:
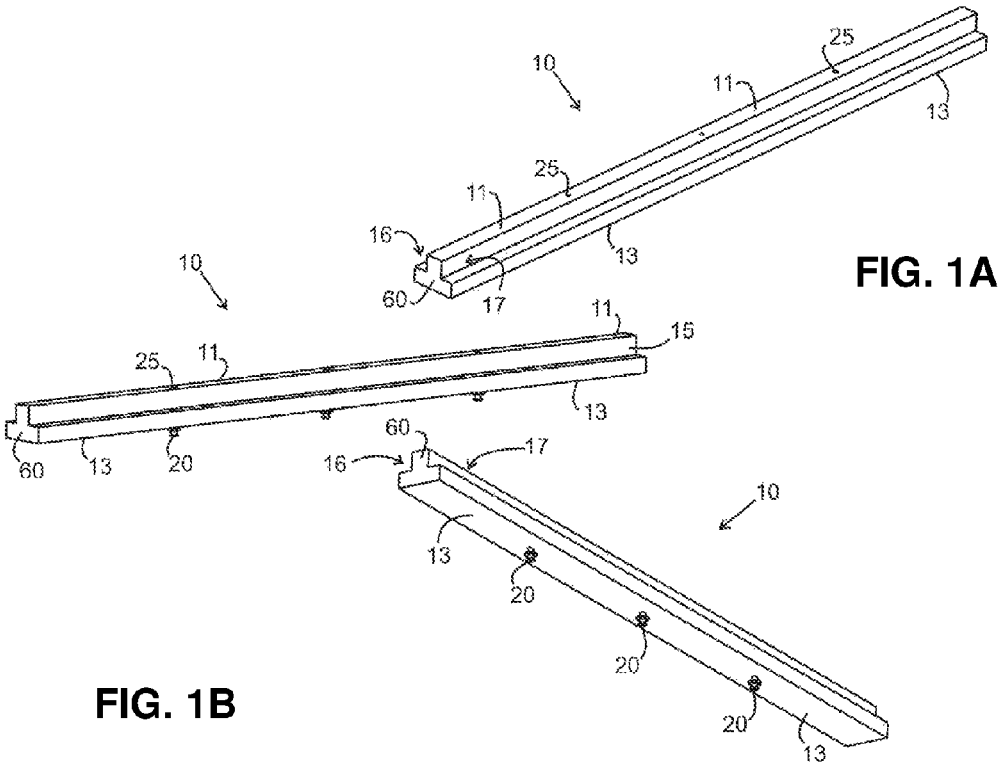
FIG. 1A is a perspective view of an inverted-T-shaped track of the present invention.
FIG. 1B is a perspective view of an inverted-T-shaped track of the present invention.
FIG. 1C is a perspective view of an inverted-T-shaped track of the present invention.

FIGS. 1A, 1B and 1C show an inverted-T-shaped track 10 of the present invention wherein the inverted-T-shaped track 10 having a top surface 11 and a bottom surface 13, and wherein the inverted-T-shaped track 10 comprises of a longitudinal support bar 60 with two longitudinal flanges 16-17 at a right side and a left side on the top surface 11.

Again as shown in FIGS. 1A, 1B and 1C, the inverted-T-shaped track 10 further has a plurality of adjustable supporting legs 20 attached to the bottom surface 13, wherein the adjustable supporting leg 20 having an adjusting means 25 accessible from the top surface 11 to adjust the length.

As shown in FIGS. 2A, 2B, 3 and 4, the inverted-T-shaped track 10 has a plurality of adjustable supporting legs 20 mounted thereon. The inverted-T-shaped track 10 is a longitudinal bar made of rigid insulation material with two cut-outs (flanges) 16-17 at the top surface 11. The inverted-T-shaped track 10 can be in any length based on the flooring system and also two cut-outs (flanges) 16-17 can be in different width and depth. A raised flooring system or a subfloor rests on the top surface 11 of the inverted-T-shaped track 10 and the adjustable supporting legs 20 are placed on a base floor 100. Two L-shaped side walls 14-15 of the inverted-T-shaped track 10 have two flanges 16-17 on both sides of the inverted-T-shaped track 10 to support an insulation panel 18 on each side. The insulation panel 18 is rested on the lower part of the L-shaped side wall 15,16.

The adjustable support legs 20 are mounted spaced apart on longitudinal length of the inverted-T-shaped track 10. The adjustable support legs 20 act as a pedestal to support the inverted-T-shaped track 10 on an existing floor. The adjustable support leg 20 further has an adjusting means to adjust the height of the inverted-T-shaped track 10 from the top surface 11. Each support leg 20 has a length longer than the depth of the inverted-T-shaped track 10 extending from the top surface 11 of the inverted-T-shaped track 10 along the height and protruding into the bottom surface 13 of the inverted-T-shaped track 10. Each support leg 20 has a threaded portion 22 attached to a base plate 23 on a distal end, wherein a metallic sleeve 24 navigates the threaded portion 22 along the sleeve 24. The metallic sleeve 24 attaches to the adjustable leg 20 to create a clean path to adjust the leg from the above. It also helps to secure the leg 20 in place vertically. The support leg 20 can be raised or lowered to adjust the slope of the raised flooring for water drainage. One embodiment of the adjusting means is through a screw 25 on the top surface of the inverted-T-shaped track 10.

The adjustable leg 20 is inserted in the inverted-T-shaped track 10 elevates it from the base floor 100 to create an air-gap 21 between inverted-T-shaped track 10 and the based floor for air circulation to minimize mould in wet areas underneath the flooring system. In an incident, such as water leakage in the floor, the air-gap 21 also allows water to enter below the flooring system and it navigates the water to a drain.

In a preferred embodiment, the adjustable support leg 20 is made of galvanized or stainless steel to minimize corrosion. The adjustability of the legs vary based on the height of the inverted-T-shaped track 10. In one embodiment, the minimum difference between the height of the adjustable support leg 20 and the inverted-T-shaped track 10 is ½ inches to ensure a minimal air space below the structure.

The top surface 11 and the bottom surface 13 of the inverted-T-shaped track 10 are covered with a padding of cement resin with graphite reinforcement 35. This provides an additional flexural and shear strength to the rigid insulation. The cement with graphite reinforcement may be optional once it is determined exactly what type of rigid insulation will be used for the system. The type of cement resin depends on the application and the type of rigid insulation used for the product is optional.

Figure 2A:
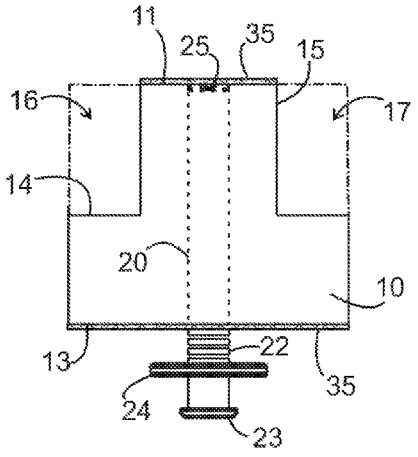
FIG. 2A is a side view of an inverted-T-shaped track of the present invention.
Figure 2B:
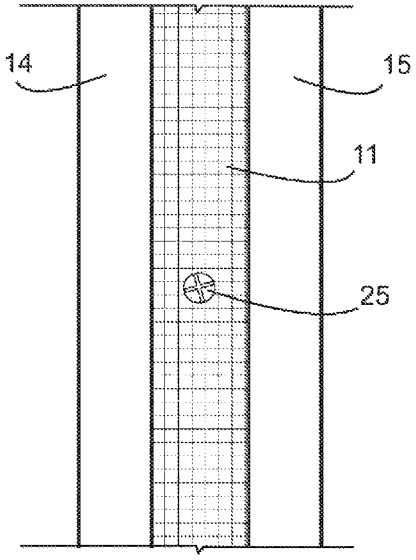
FIG. 2B is a top view of an inverted-T-shaped track of the present invention.

As shown in FIGS. 1A and 2A, the inverted-T-shaped track 10 of the present invention creates two flanges 16-17 to be used to install a plurality of devices. Notched rigid insulation panels 18 are mounted on the flanges area 16-17 on the outer sides of the inverted-T-shaped track 10 and are supported by the inverted-T-shaped track 10 from both sides. The inverted-T-shaped track 10 and panels 18 are to be bonded together with a foam board adhesive. An adhesive, rather than mechanical fasteners, is used to reduce the amount of penetrations, which can increase cold bridges through the system. The adhesive also provides a tight seal for moisture and air. The notched insulation panels 18 are supported off of the inverted-T-shaped track 10 and do not come in contact with the based floor structure. The purpose of the panels 18 are to provide bracing for the inverted-T-shaped tracks 10, a support for the floor above, and continuous insulation for sound and temperature.

Figure 3:
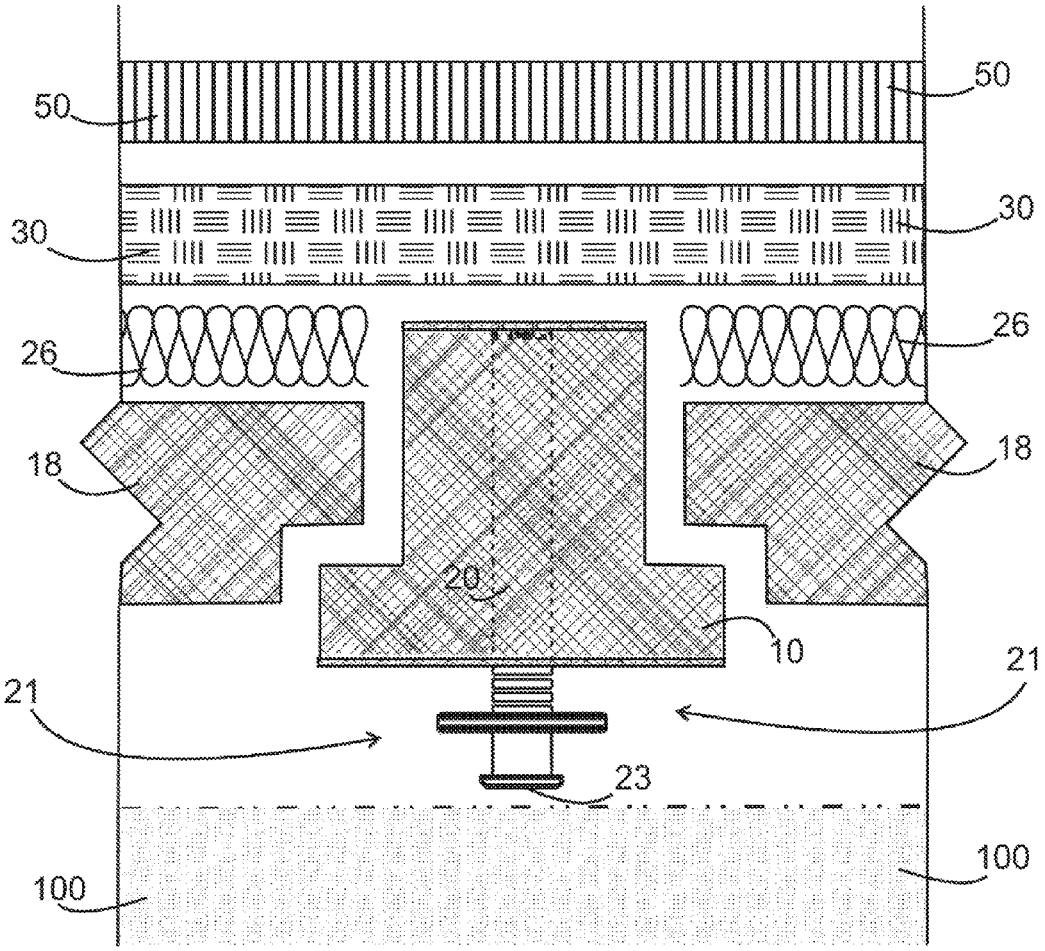
FIG. 3 is a side view of assembly of an inverted-T-shaped track of the present invention with other components.
Figure 4:
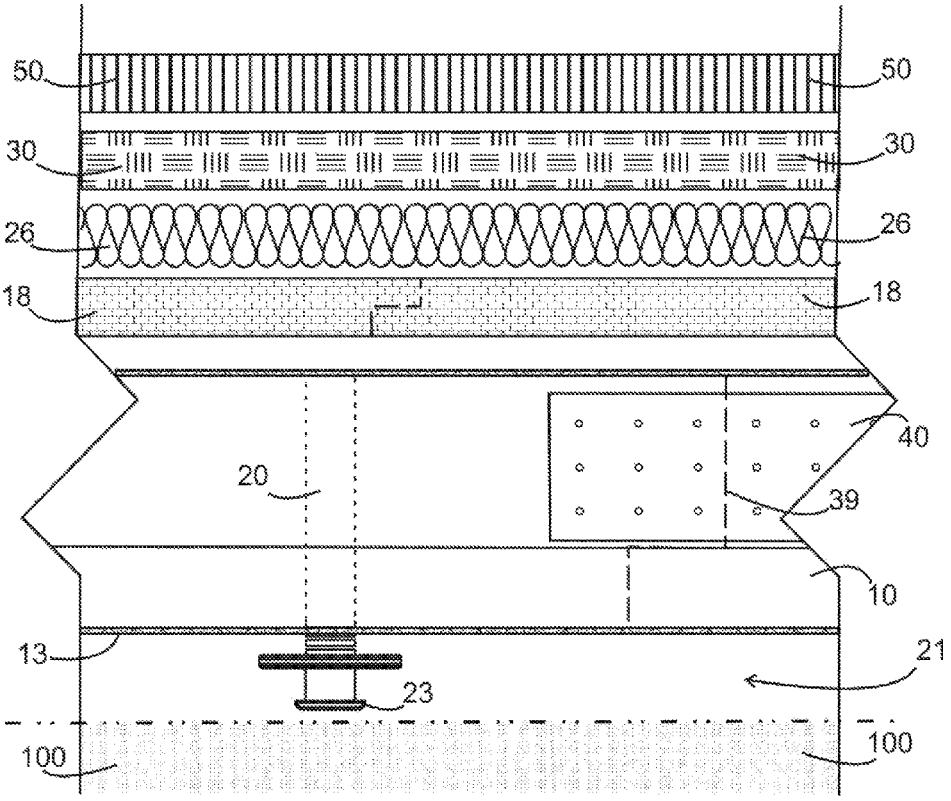
FIG. 4 is a side view of assembly of an inverted-T-shaped track of the present invention with other components.

As shown in FIGS. 3 and 4, an in-floor heating system 26 can also be optionally provided between the rigid insulation panels 18 and subfloor 30 on top of the inverted-T-shaped track 10 in the present invention. The heating system 26 is not part of the flooring system but heating and sound resistant systems can also be installed in air-gap areas 21. The heating system 26 can penetrate the inverted-T-shaped track 10 in specific locations to allow continuous flow between the rows of panels 18. The system can accommodate a radiant and/or an electric in-floor heating systems based on the preference of the owner/contractor. If a heating system 26 is not desired the flooring system depth may be reduced to increase headroom above.

In flooring system, a decorative flooring such as carpets, a hardwood or laminate panels are usually bonded to the subfloor (plywood, particleboard, chipboard, medium density fibreboard, etc.), for added structural stability. Various coupling profiles are known for connecting adjacent flooring panels.

As shown in FIGS. 4, 5, 6 and 7, a plurality of inverted-T-shaped tracks 10 can be connected to each other according to the flooring area. The lap joint 39 of adjacent inverted-T-shaped tracks can be fastened together to create a continuous track. The lap joint 39 in inverted-T-shaped track provides additional connection capacity while reducing possibility of airflow or leakage through the flooring system. The lap joint 39 enables to keep the top surfaces 11 of the two adjacent inverted-T-shaped tracks 10 flush while improving the strength of the assembly.

As shown in FIG. 4, the connection system of the inverted-T-shaped tracks 10 comprises of a galvanized or a stainless steel nailed plate 40 provided on the lap joint 39 of two adjacent inverted-T-shaped tracks 10. Nailed plate 40 fastens lap joint 39 of inverted-T-shaped track together.

Figure 5:
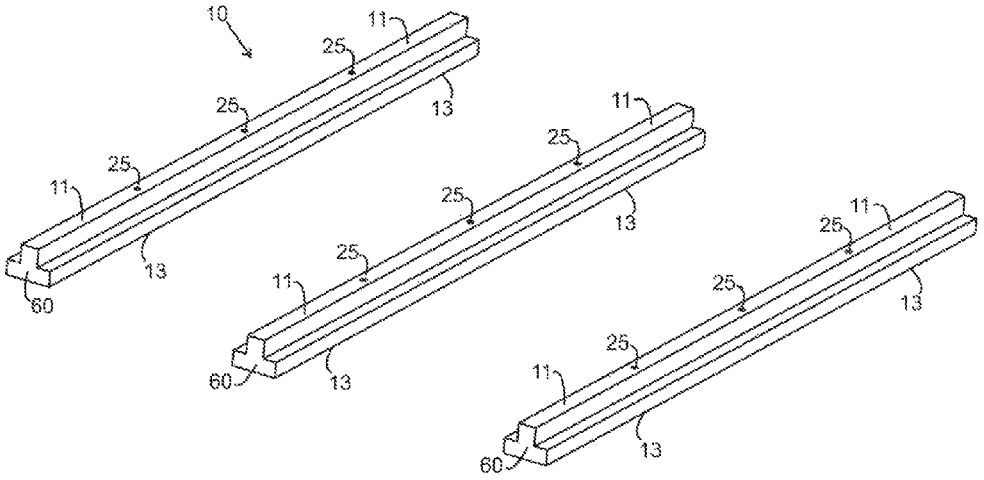
FIG. 5 is a perspective view of three inverted-T-shaped tracks of the present invention.
Figure 6:
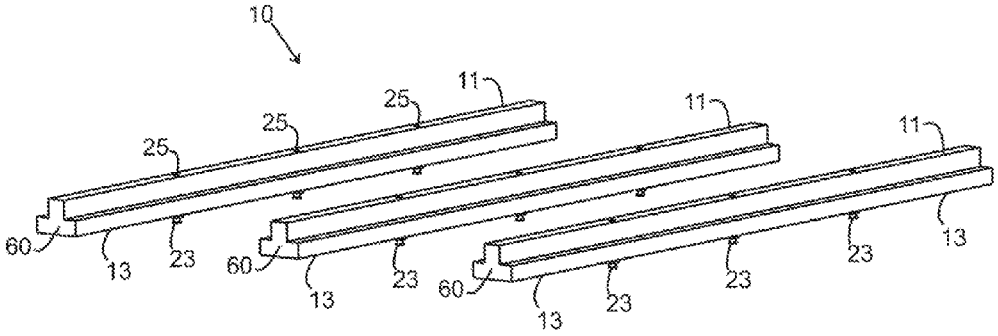
FIG. 6 is a perspective view of three inverted-T-shaped tracks of the present invention.
Figure 7:
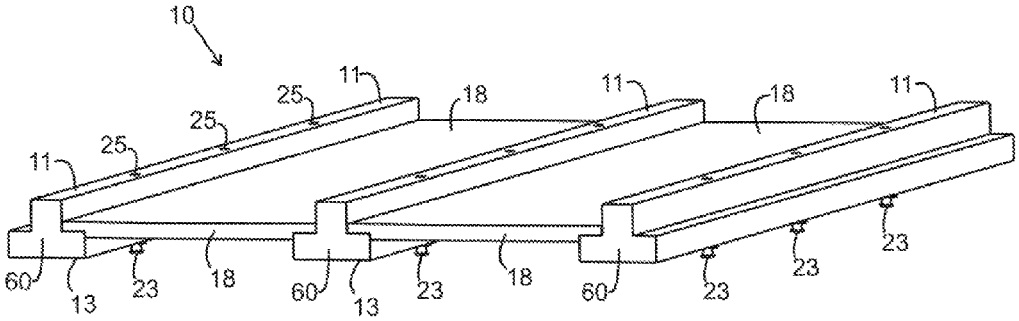
FIG. 7 is a perspective view of three inverted-T-shaped tracks of the present invention.

As shown in FIGS. 5, 6 and 7, the inverted-T-shaped tracks 10 install parallel to each other in a dimension of 16 to 24 inches apart based on the floor make-up and provide opening areas to allow in-floor heating 26 or other mechanical services to run between the gap areas of the flooring structure. Subsequently rigid insulation panels 18 will be mounted between the adjacent inverted-T-shaped tracks 10. The longitudinal edges of the insulation panels 18 are shaped and dimensioned to overlap with the inverted-T-shaped track 10 on each side and fastened by adhesive such as foam board adhesive or other fastening means.

The inverted-T-shaped track 10 is laid on the floor structure and is supported off of the floor by the adjustable legs 20 and the height is adjusted prior to the installation of the rigid insulation panels 18. The top surface is then covered by a subfloor 30 and finished flooring surface 50 is placed and fastened onto the subfloor 30. Minimum ⅝" Plywood or OSB subfloor 30 is bonded to inverted-T-shaped track 10 with adhesive. The subfloor 30 helps to distribute the floor loading above to adjustable support legs 20. Flooring adhesive and other fasteners may be used additionally during installation. Additional holes may be drilled in the subfloor 30 to adjust the height of the system at a later phase as desired.

The proposed flooring system can be placed on any type of existing flooring structure assuming that the flooring structure is capable of supporting the proposed system. The system can be placed on existing or new concrete floors in basements or on suspended wood, steel or other flooring structures.

A method for installation of inverted-T-shaped track on a floor is provided in following steps:

Step one: clean and remove all dirt and debris from the top of the floor where the inverted-T-shaped track system will be placed.

Step two: place inverted-T-shaped track along outer edge of the floor starting at one corner.

Step three: cut portions of the inverted-T-shaped track to fit within the floor edge area.

Step four: connect the inverted-T-shaped track sections which are in line with one another with the provided fastening plates.

Step five: adjust the height of the legs of the inverted-T-shaped track to create a level surface on top.

Step six: place and additional row of inverted-T-shaped track parallel to the first row. Spacing distance between tracks is dependent on floor landing.

Step seven: Repeat step 3-5

Step eight: place polyurethane (compatible with rigid insulation) on flange of inverted-T-shaped track.

Step nine: place rigid insulation panels between the parallel track sections while the polyurethane is still wet. Panel lips are to rest on the flange on the inverted-T-shaped track. Allow polyurethane to dry and reach design strength before apply weight onto the system.

Step ten: repeat steps 6-9 until desired area of floor has been covered with the inverted-T-shaped track system.

Step eleven: (Optional) place in floor heating system on top of the rigid panels.

Step twelve: provide polyurethane on top of the inverted-T-shaped tracks and place sub floor on top while polyurethane is still wet. Thickness and type of subfloor should be determined by designer of the project.

Step thirteen: add floor finish of choice on top of subfloor.

Step fourteen: allow polyurethane to dry and reach design strength before applying load onto the sub floor.

A method for installation of a plurality of inverted-T-shaped tracks on a floor having a width and a length, the method comprises of following steps:

cleaning and removing all dirt and debris from the floor;

placing inverted-T-shaped track along an outer edge on the floor starting at one corner of the floor;

cutting a portion of the inverted-T-shaped track to fit within the floor edge area;

connecting the inverted-T-shaped track sections along the length of the floor with one another with a fastening plate;

adjusting the height of the legs of the inverted-T-shaped track to create a level surface;

placing an additional row of inverted-T-shaped track parallel to the first row and providing a spacing distance between tracks dependent on floor landing.

Step seven: Repeat step 3-5

Step eight: place polyurethane (compatible with rigid insulation) on flange of inverted-T-shaped track.

Step nine: place rigid insulation panels between the parallel track sections while the polyurethane is still wet. Panel lips are to rest on the flange on the inverted-T-shaped track. Allow polyurethane to dry and reach design strength before apply weight onto the system.

Step ten: repeat steps 6-9 until desired area of floor has been covered with the inverted-T-shaped track system.

Step eleven: (Optional) place in floor heating system on top of the rigid panels.

Step twelve: provide polyurethane on top of the inverted-T-shaped tracks and place sub floor on top while polyurethane is still wet. Thickness and type of subfloor should be determined by designer of the project.

Step thirteen: add floor finish of choice on top of subfloor.

Step fourteen: allow polyurethane to dry and reach design strength before applying load onto the sub floor.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. An inverted-T-shaped insulation for raised flooring system comprising:

a) a plurality of inverted-T-shaped insulation to be laid down on a base floor to support a raised floor, wherein each said inverted-T-shaped insulation has a top surface, a bottom surface, and an insulation-height and wherein said top surface and said bottom surface further have a reinforced cement resin layer to provide flexural and shear strength to said inverted-T-shaped insulation;

b) a plurality of adjustable supporting legs inserted through said T-shaped insulation from said bottom surface and extending to said top surface, wherein each said adjustable supporting leg having a distal end and a proximal end, said distal end places on said base floor and said proximal end is accessible from the top surface and has a means to adjust the height of said adjustable supporting legs, and whereby the bottom surface of the inverted-T-shaped insulation is mounted on the base floor, and a set of insulation panels are placed on the T-shaped insulation to provide a continuous layer of insulation on a floor, and the raised floor is built on the top surface.

2. The inverted-T-shaped insulation of claim 1, wherein said means to adjust is a screw with a sleeve, said screw has a head at the top surface and a threaded portion attached to a base plate on said distal end, wherein said sleeve navigates said threaded portion along said sleeve.

3. The inverted-T-shaped insulation of claim 1, wherein said inverted-T-shaped insulation is made of a rigid insulation material to regulate the temperature of the base floor and to reduce energy loss.

4. The inverted-T-shaped insulation of claim 1, wherein said adjustment means is a screw with a threaded portion.

5. The inverted-T-shaped insulation of claim 1, wherein said leg-height is longer than said insulation-height.

6. The inverted-T-shaped insulation of claim 5, wherein the minimum difference between said leg-height and said insulation-height is ½ inches to ensure a minimal air space below the raised flooring system.

* * * * *